US009618240B2

(12) United States Patent
Prohaska

(10) Patent No.: US 9,618,240 B2
(45) Date of Patent: Apr. 11, 2017

(54) REFRIGERANT COOLING AND/OR CONDENSING APPARATUS, SYSTEM AND METHOD

(71) Applicant: Randy Prohaska, Marengo, IL (US)

(72) Inventor: Randy Prohaska, Marengo, IL (US)

( * ) Notice: Subject to any disclaimer, the term of this patent is extended or adjusted under 35 U.S.C. 154(b) by 264 days.

(21) Appl. No.: 14/339,651

(22) Filed: Jul. 24, 2014

(65) Prior Publication Data

US 2016/0025387 A1 Jan. 28, 2016

(51) Int. Cl.
*F25B 21/02* (2006.01)
*F25B 45/00* (2006.01)
*F25B 39/04* (2006.01)

(52) U.S. Cl.
CPC ..... *F25B 21/02* (2013.01); *F25B 39/04* (2013.01); *F25B 45/00* (2013.01); *F25B 2321/025* (2013.01); *F25B 2345/002* (2013.01)

(58) Field of Classification Search
CPC ..... F25B 21/02; F25B 45/00; F25B 39/04; F25B 2345/002; F25B 2321/025; F25B 2345/003; F25B 2345/004; F17C 6/00; F17C 2260/044; F17C 2221/033; F17C 5/00; F17C 5/02
USPC ..... 62/3.2, 292, 606, 77
See application file for complete search history.

(56) References Cited

U.S. PATENT DOCUMENTS 3,226,602 A * 12/1965 Elfving ..... F25B 21/02 165/170
4,311,017 A * 1/1982 Reed ..... F25B 21/02 62/3.64
5,007,242 A * 4/1991 Nakayama ..... A47F 3/0495 62/247
6,173,575 B1 * 1/2001 Hall ..... B26D 1/00 62/3.2
7,272,936 B2 * 9/2007 Feher ..... B60N 2/5635 62/3.3
9,395,109 B2 * 7/2016 Berger ..... F04B 39/064
2003/0215341 A1 * 11/2003 Maiefski ..... F04B 9/042 417/313
2004/0194496 A1 * 10/2004 Gleason ..... A47G 19/26 62/457.9
2008/0247441 A1 * 10/2008 Salvetti ..... G01K 17/00 374/33
2009/0071981 A1 * 3/2009 Scardino ..... F25B 21/02 222/146.6
2011/0083446 A1 * 4/2011 Pinet ..... F25B 21/02 62/3.6

* cited by examiner

*Primary Examiner* — Mohammad M Ali
(74) *Attorney, Agent, or Firm* — Scherrer Patent & Trademark Law, P.C.; Stephen T. Scherrer; Monique A. Morneault

(57) ABSTRACT

The present invention relates to a refrigerant cooling and/or condensing apparatus, system and method. Specifically, the present invention provides a cooling apparatus for cooling and condensing refrigerant from air conditioners, refrigerators, and other like mechanical cooling devices for collecting the same. Specifically, the cooling apparatus comprises a cold plate having a cooling coil, a heat plate with one or more heat sinks attached thereto wherein heat is transferred from the cold plate to the heat plate, and a fan for cooling the heat plate, further wherein gaseous refrigerant is sent through the coil, and heat is removed therefrom and transferred to the heat plate. The cooled refrigerant is then easily collected in a tank or other receptacle.

19 Claims, 4 Drawing Sheets

REFRIGERANT COOLING AND/OR CONDENSING APPARATUS, SYSTEM AND METHOD

TECHNICAL FIELD

The present invention relates to a refrigerant cooling and/or condensing apparatus, system and method. Specifically, the present invention provides a cooling apparatus for cooling and condensing refrigerant from air conditioners, refrigerators, and other like mechanical cooling devices for collecting the same. Specifically, the cooling apparatus comprises a cold plate having a cooling coil, a heat plate with one or more heat sinks attached thereto wherein heat is transferred from the cold plate to the heat plate, and a fan for cooling the heat plate, further wherein gaseous refrigerant is sent through the coil, and heat is removed therefrom and transferred to the heat plate. The cooled refrigerant is then easily collected in a tank or other receptacle.

BACKGROUND

It is, of course, generally known to use mechanical devices for cooling, such as air conditioners and refrigerators, for example. Specifically, an air conditioner or a refrigerator uses a system to blow air over chilled coils, removing heat from the air and chilling the air. The chilled air then moves into an enclosed space to chill the enclosed space. In an air conditioner, the chilled air is forced into a building, such as a house or other structure. In a refrigerator, the chilled air is forced into a thermally sealed, insulated and enclosed space for keeping foods chilled and fresh. Of course, refrigerants are known for use in many other applications as apparent to one of ordinary skill in the art.

Refrigeration systems generally comprise a refrigerant, commonly known as "Freon," which, through an enclosed cycle, moves repeatedly through a series of compression and expansion. The refrigerant is a chemical that is compressed to form a liquid and sent through coils, where heat generated from the compression is transferred to air flowing over the coils and blown off to cool down the compressed refrigerant. The refrigerant is then passed through an expansion valve and into cooling coils, where the compressed refrigerant experiences a pressure drop, changing from the compressed liquid to a gas through cooling coils. Heat is removed from air as the air is blown over the cooling coils, thereby chilling the air, and the chilled air is then moved into the enclosed space for cooling the enclosed space, whether into a building or a refrigerator. The refrigerant is then compressed in a compressor into a liquid and the cycle repeats itself.

Refrigerant contained within the air conditioner or refrigerator is typically utilized over and over again in a repeating cycle of compression and expansion. However, in many cases, leaks may develop in the systems, requiring additions to or even replacement of the refrigerant. Moreover, the common Freon utilized in air conditioners, known as R22, is known to cause problems in the environment, namely damage to the ozone layer of earth. Therefore, the more environmentally-friendly R410A is typically utilized as a replacement. If air conditioners or refrigerators require additions or repair, the R22 is typically removed and the R410A is typically added, thereby replacing the refrigerant.

Replacing the refrigerant in these systems is often difficult. Typically, refrigerant is removed from the air conditioners or refrigerators in the evaporated or gaseous form. However, it is often difficult to collect the refrigerant. Considering that the refrigerant typically removed from air conditioners and/or refrigerators is often the environmentally-damaging R22 Freon, it is very important that the refrigerant is collected and not released into the atmosphere where it can cause environmental damage. A need exists, therefore, for an apparatus, system and method for collecting refrigerant removed from an air conditioner or a refrigerator. Specifically, a need exists for an apparatus, system and method for easily and efficiently collecting refrigerant without releasing the same to the atmosphere.

Since refrigerant is typically removed as a gas from an air conditioner or a refrigerator, it must be collected in tanks. However, it is often difficult to fill a tank to capacity with hot gas, as the pressure of a tank rapidly increases as gaseous refrigerant is added. In other words, a tank can be filled with relatively little gaseous refrigerant before the tank is filled and will not accept further refrigerant. Oftentimes, one who removes and collects the refrigerant must replace tanks during the collection process. As tanks are moved and replaced, the potential for accidental release of the refrigerant increases. A need, therefore, exists for an apparatus, system and method for collecting refrigerant from an air conditioner and/or refrigerator that allows a tank to collect relatively more refrigerant than typical methods. Moreover, a need exists for an apparatus, system and method that reduce the potential of accidental release of refrigerant into the atmosphere.

Common techniques for collecting gaseous refrigerant typically involve cooling the refrigerant thereby reducing the volume of the same or even condensing the same prior to collection. Specifically, it is common to utilize an ice chest and a pipe through the ice chest that carries the gaseous refrigerant. However, it is often difficult to utilize the ice chest, as a relatively large, bulky space to contain a large amount of ice must be utilized. The ice melts, especially on hot days, which may cause a mess, especially if the chest develops a leak. Moreover, it may simply be difficult to obtain the required quantity of ice to prepare the ice chest for cooling the refrigerant. Once melted, a further supply of ice must be utilized to capture and collect additional refrigerant. A need, therefore, exists for an apparatus, system and method for collecting refrigerant without requiring use of an ice chest. Further, a need exists for an apparatus, system and method for cooling refrigerant that is relatively clean, easy to operate, quick to set-up and utilize without mess.

SUMMARY OF THE INVENTION

The present invention relates to a refrigerant cooling and/or condensing apparatus, system and method. Specifically, the present invention provides a cooling apparatus for cooling and condensing refrigerant from air conditioners, refrigerators, and other like mechanical cooling devices for collecting the same. Specifically, the cooling apparatus comprises a cold plate having a cooling coil, a heat plate with one or more heat sinks attached thereto wherein heat is transferred from the cold plate to the heat plate, and a fan for cooling the heat plate, further wherein gaseous refrigerant is sent through the coil, and heat is removed therefrom and transferred to the heat plate. The cooled refrigerant is then easily collected in a tank or other receptacle.

To this end, in an embodiment of the present invention, an apparatus for cooling and/or condensing refrigerant is provided. The apparatus comprises an apparatus for cooling refrigerant, the apparatus comprising: a thermoelectric cooler comprising a cold plate, a heat plate and a thermoelectric material between the cold plate and the heat plate for cooling the cold plate and heating the heat plate when voltage is applied across the thermoelectric material; a cooling coil adjacent the cold plate; and a fan disposed adjacent the heat plate for cooling said heat plate, wherein the refrigerant is sent through the cooling coil to be cooled by the cold plate.

In an embodiment, the cooling coil has an inlet and an outlet, wherein the inlet accepts the refrigerant and the outlet expels cooled refrigerant.

In an embodiment, the refrigerant is gaseous.

In an embodiment, the refrigerant enters the inlet of the cooling coil and liquid exits the outlet of the cooling coil.

In an embodiment, the apparatus further comprises a power source electrically connected to the thermoelectric cooler.

In an embodiment, the apparatus further comprises a power source electrically connected to the fan.

In an embodiment, the fan is disposed within a vented housing, and further wherein an airflow is pulled in the vented housing by the fan, propelled towards the heat plate, and subsequently pushed out of the vented housing.

In an embodiment, the cooling coil is a six-pass coil.

In an embodiment, the heat plate has one or more heat sinks disposed thereon for dissipating heat.

In an embodiment, the apparatus further comprises a housing encapsulating the thermoelectric cooler, the cooling coil, and the fan.

In an embodiment, the apparatus further comprises a handle disposed on a top of the housing.

In an embodiment, the apparatus further comprises a plurality of vent holes disposed in the housing In alternate embodiment of the present invention, a system for cooling refrigerant is provided. The system comprises: a refrigeration device utilizing refrigerant for cooling an enclosed space; a cooling apparatus comprising a thermoelectric cooler comprising a cold plate, a heat plate and a thermoelectric material between the cold plate and the heat plate for cooling the cold plate and heating the heat plate when voltage is applied across the thermoelectric material; a cooling coil adjacent the cold plate; and a fan disposed adjacent the heat plate for cooling said heat, wherein said cooling coil has an inlet and an outlet, the inlet accepts refrigerant from the refrigeration device and the outlet expels cooled refrigerant.

In an embodiment, the system further comprises: a refrigerant reclaimer that moves refrigerant from the refrigeration device to the cooling apparatus; and a container that collects cooled refrigerant expelled from the cooling apparatus, wherein the refrigerant reclaimer is connected to the refrigeration device on one end and connected to the inlet of the cooling apparatus on another end, and further wherein the container is connected to the outlet of the cooling apparatus.

In an embodiment, the cooling coil is a six-pass coil.

In an embodiment, the heat plate has one or more heat sinks disposed thereon for dissipating heat.

In an alternate embodiment of the present invention, a method for cooling refrigerant is provided. The method comprises the steps of: providing a cooling apparatus comprising a thermoelectric cooler comprising a cold plate, a heat plate and a thermoelectric material between the cold plate and the heat plate for cooling the cold plate and heating the heat plate when voltage is applied across the thermoelectric material, a cooling coil adjacent the cold plate; and a fan disposed adjacent the heat plate for cooling said heat plate, wherein said cooling coil comprises an inlet and an outlet, the inlet accepting the refrigerant and the outlet expelling cooled refrigerant; sending refrigerant into the inlet of the cold plate; applying voltage across the thermoelectric cooler thereby cooling the cold plate; cooling the refrigerant in the cooling coil; and cooling the heat plate with the fan.

In an embodiment, the method further comprises the step of collecting the cooled refrigerant from the outlet of the cooling coil in a container.

In an embodiment, the method further comprises the step of providing a refrigeration device for cooling an enclosed space.

In an embodiment, the method further comprises the steps of: providing a refrigerant reclaimer for drawing refrigerant from the refrigeration device; and moving the refrigerant from the refrigeration device to inlet of the cooling coil with the refrigerant reclaimer.

It is, therefore, an advantage and objective of the present invention to provide an apparatus, system and method for collecting refrigerant removed from an air conditioner or a refrigerator.

Specifically, it is an advantage and objective of the present invention to provide an apparatus, system and method for easily and efficiently collecting refrigerant without releasing the same to the atmosphere.

In addition, it is an advantage and objective of the present invention to provide an apparatus, system and method for collecting refrigerant from an air conditioner and/or refrigerator that allows a tank to collect relatively more refrigerant than typical methods.

Moreover, it is an advantage and objective of the present invention to provide an apparatus, system and method that reduce the potential of accidental release of refrigerant into the atmosphere.

Further, it is an advantage and objective of the present invention to provide an apparatus, system and method for collecting refrigerant without requiring use of an ice chest.

Still further, it is an advantage and objective of the present invention to provide an apparatus, system and method for cooling refrigerant that is relatively clean, easy to operate, quick to set-up and utilize without mess.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a refrigerant cooling and/or condensing apparatus, system and method. Specifically, the present invention provides a cooling apparatus for cooling and condensing refrigerant from air conditioners, refrigerators, and other like mechanical cooling devices for collecting the same. Specifically, the cooling apparatus comprises a cold plate having a cooling coil, a heat plate with one or more heat sinks attached thereto wherein heat is transferred from the cold plate to the heat plate, and a fan for cooling the heat plate, further wherein gaseous refrigerant is sent through the coil, and heat is removed therefrom and transferred to the heat plate. The cooled refrigerant is then easily collected in a tank or other receptacle.

Figure 1:
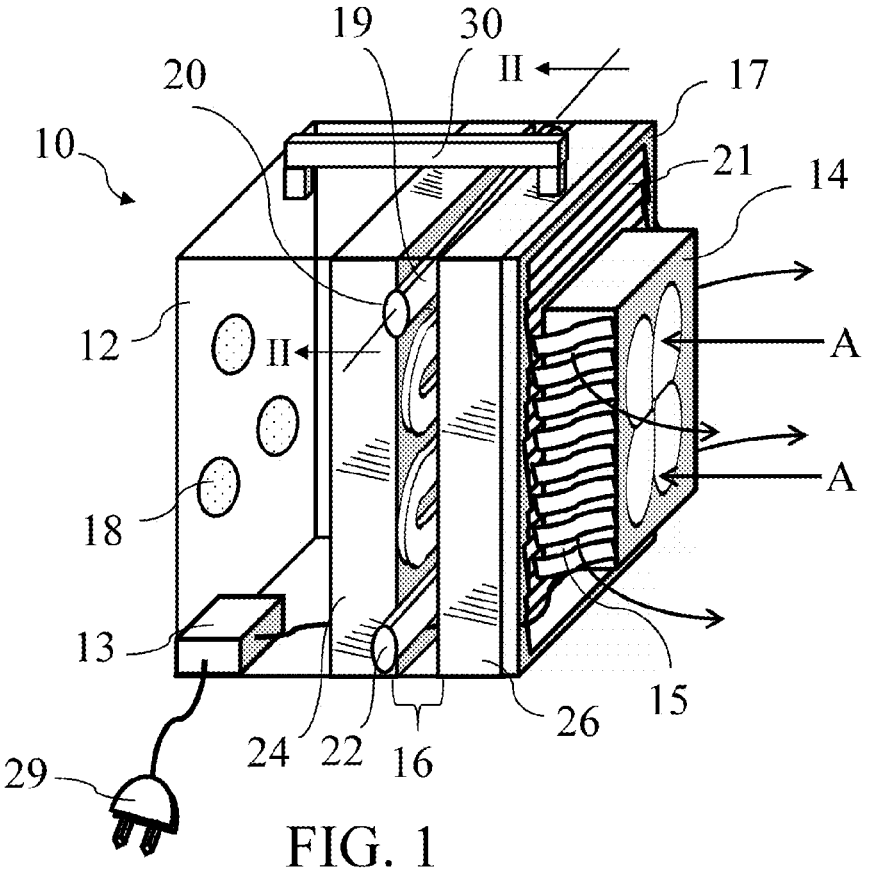
FIG. 1 illustrates a perspective view of a cooling apparatus in an embodiment of the present invention.

Now referring to the figures, wherein like numerals refer to like parts, FIG. 1 illustrates a cooling apparatus 10 for cooling and/or condensing refrigerant or other fluids. Specifically, the apparatus 10 comprises a housing 12 containing a fan 14, a plurality of fan vents 15, a cold plate 16, a heat plate 17, and vent holes 18 for venting heated air generated from an ac/dc converter 13 or other ambient heated air from the apparatus 10. The cold plate 16, the heat plate 17, and the ac/dc converter may act together to form a thermoelectric cooler, otherwise known as a "Peltier cooler". Specifically, the Peltier effect may be created when the cold plate 16, the heat plate 17, and the ac/dc converter act together. The Peltier effect refers to the generation or removal of heat created when a voltage is applied across two different materials, typically ceramic semi-conductors, or other conductive material known to one skilled in the art. When voltage is applied across the materials, a temperature differential is created, creating a cooled region (the cold plate 16) and a heated region (the heat plate 17). The cold plate 16 may be utilized to remove heat from another material, as described below.

In a preferred embodiment, the ac/dc converter may apply voltage between the cold plate 16 and the heat plate 17 through the thermoelectric cooler. Additionally, the fan 14 may be positioned adjacent the heat plate 17 and directed to blow thereon in order to cool the heat plate 17, thereby removing heat from the system. The heat plate 17 may additionally have one or more heat sinks 21 thereon in order to dissipate heat faster and efficiently. An airflow A may therefore be created to blow onto the heat plate 17. The airflow A may then traverse outwardly through the plurality of fan vents 15, as shown in FIG. 1, effectively cooling down the heat plate 17. Subsequently, additional heat may then be removed from the cold plate 16 and transferred to the heat plate 17, as previously discussed, and the heat plate 17 may be cooled thereafter. This process may continuously repeat.

Specifically, the cold plate 16 may contain a coil 19 having an inlet 20 and an outlet 22, whereby refrigerant may be added to the coil 19 through the inlet 20 and the refrigerant may further be expelled therefrom through the outlet 22. The coil 19 may be made of a thermally conducting metal, such as, for example, copper, and may wind through the cold plate 16 to provide a large amount of surface area for exchanging heat between the refrigerant flowing therethrough and the heat flow caused by the Peltier effect. The coil 19 may be sandwiched or other embedded within a first layer 24 of a combination of high surface area fins made from a thermally conductive material, such as metal, and thermal insulation, and a second layer 26 of high surface area fins made from a thermally conductive material, such as metal, and thermal insulation. The heat flow caused by the Peltier effect may be increased by sandwiching the coil 19 within the first layer 24 and the second layer 26.

Figure 2:
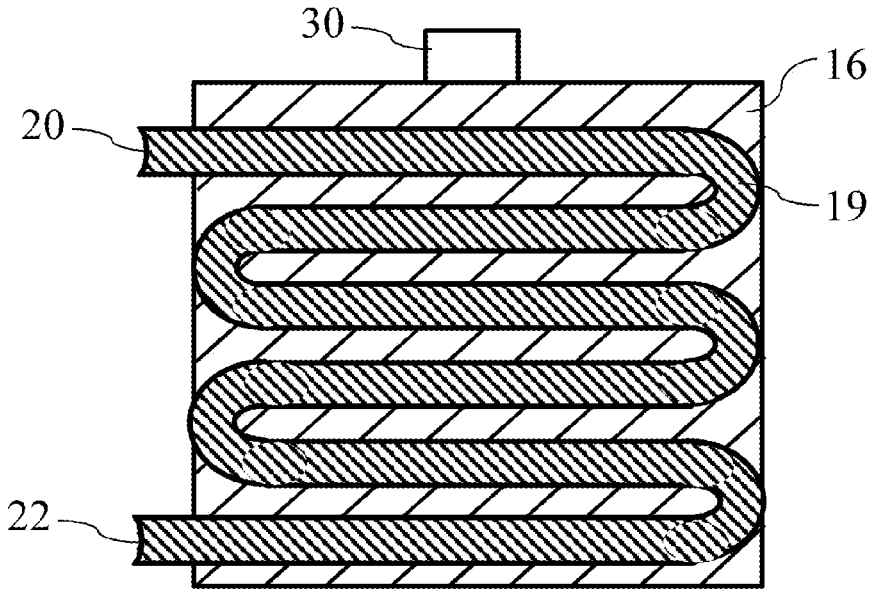
FIG. 2 illustrates a cross-sectional view along line II-II of a cooling apparatus in an embodiment of the present invention.

It should be noted that the coil should be of sufficient length providing sufficient surface area for the requisite heat exchange. For example, as illustrated in FIGS. 1 and 2, a cross-sectional view of FIG. 1 along line II-II, the coil may be a six-pass coil, providing significant length and, therefore surface area for the heat exchange. However, any length of coil may be utilized as necessary to effect the heat exchange, and the present invention should not be limited as described herein.

Figure 3:
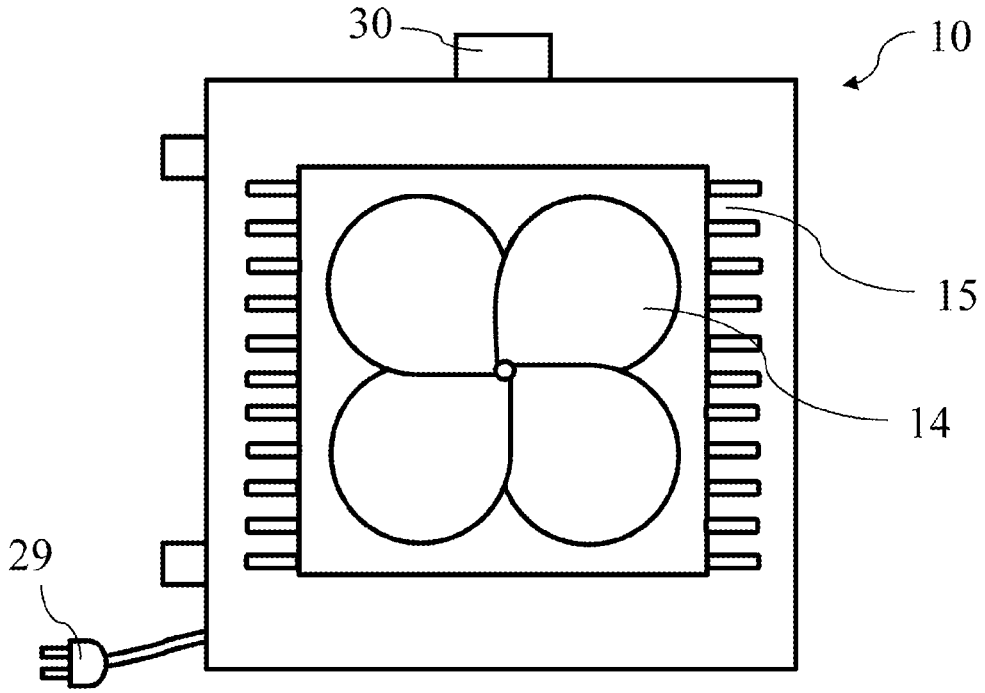
FIG. 3 illustrates a side view of a cooling apparatus in an embodiment of the present invention.
Figure 4:
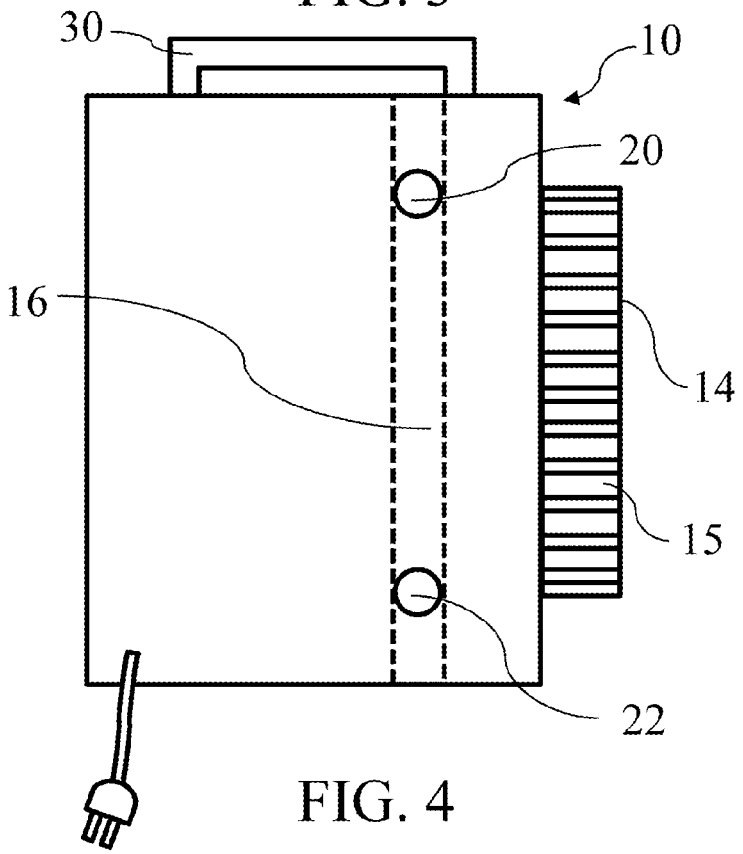
FIG. 4 illustrates a front view of a cooling apparatus in an embodiment of the present invention.
Figure 5:
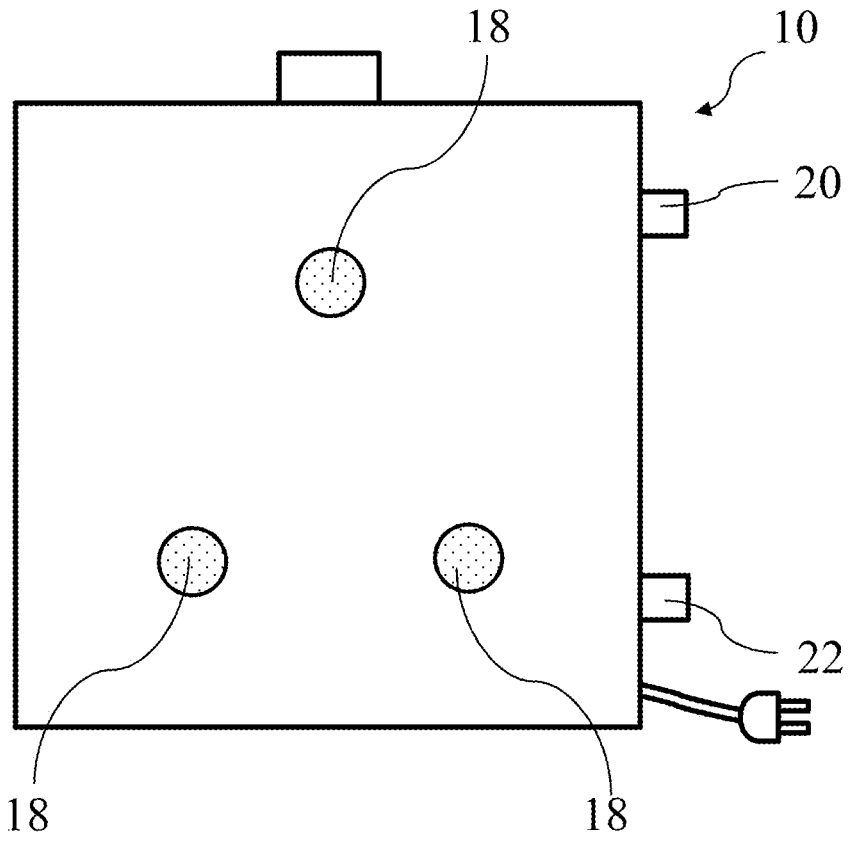
FIG. 5 illustrates an alternate side view of a cooling apparatus in an embodiment of the present invention.

FIG. 3 illustrates a side view of the apparatus 10 of the present invention showing the fan 14 that may be utilized to blow air on the heat plate 17 to cool it. A power cord 29 for powering the fan 14 may further be provided, and may be connected to the ac/dc converter 13, as illustrated in FIGS. 1 and 2-5. Alternatively, the fan 14 may be powered via batteries, or any other power source apparent to one of ordinary skill in the art. FIG. 4 illustrates a front view of the apparatus 10 of the present invention showing the inlet 20 and the outlet 22 of the coil 19. FIG. 5 illustrates an alternate side view of the apparatus 10 of the present invention showing the vent holes 18 for venting heated air from the ac/dc converter 13 or heated air not transferred to the heat plate 17. Also, as illustrated in the drawings, a convenient handle 30 may be provided for easily carrying the apparatus 10.

Figure 6:
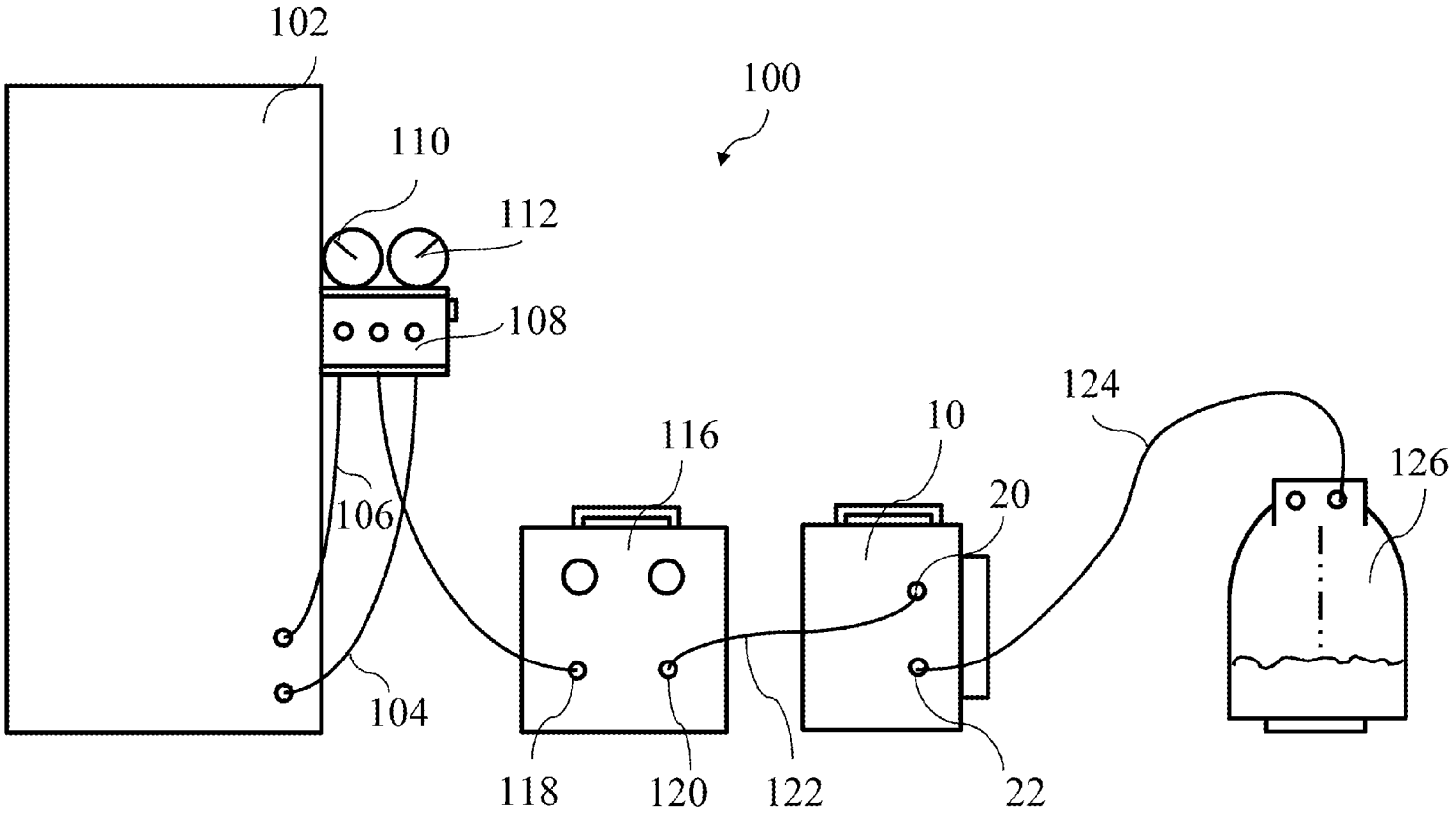
FIG. 6 illustrates a system of cooling and collecting refrigerant in an embodiment of the present invention.

FIG. 6 illustrates a system 100 in an embodiment of the present invention. The system 100 may comprise a refrigeration device 102 having refrigerant therein. The refrigeration device 102 may be an air conditioner, a refrigerator, or any other refrigeration device utilizing refrigerant for cooling. Refrigerant discharge lines 104, 106 may allow refrigerant to be removed from the refrigeration device 102 through manifold 108 having gauges 110, 112 thereon to regulate and monitor the pressure of refrigerant removed from the refrigeration device 102 through the discharge lines 104, 106. An outlet line 114 may extend from the manifold 108 to a refrigerant reclaimer 116, which may provide suction to the refrigeration device 102 to remove refrigerant from the refrigeration device 102. The refrigerant reclaimer 116 may have an inlet 118 and an outlet 120, moving refrigerant therethrough into an apparatus 10 of the present invention. A first refrigerant transfer line 122 may move refrigerant from the outlet 120 of the refrigerant reclaimer 116 to the inlet 20 of the cooling apparatus 10, where refrigerant may flow therethrough and be cooled by the apparatus 10.

The refrigerant may be expelled from the apparatus 10 in a cooled state via the outlet 22 of the apparatus 10 and may be transferred via a second transfer line 124 to a tank 126 which may be utilized for collecting the refrigerant therein. Because the refrigerant is cooled and/or condensed via the apparatus 10, the refrigerant may have less volume per unit than prior to cooling. Thus, the refrigerant may more easily be added to the tank 126. Therefore, the tank 126 may hold more refrigerant, allowing for the collection of refrigerant from the refrigeration device 102 without having to change the tank 126 to ensure that the entirety of the refrigerant is removed from the refrigeration device 102. Thus, it is easier and more efficient to remove refrigerant from the refrigeration device 102 than without cooling the refrigerant, potentially reducing accidental releases of refrigerant, such as the environmentally-damaging R22 Freon.

In an alternate embodiment of the present invention, air may blow across the coil 19 and the first layer 24 and second layer 26 directly from the fan 14 and may exchange heat from the refrigerant to the air blowing thereacross, cooling the refrigerant flowing through the coil 19. Specifically, the heated refrigerant may be cooled as heat from the refrigerant is transferred to the air flowing thereacross.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. An apparatus for cooling refrigerant from a refrigeration device, the apparatus comprising:

a thermoelectric cooler comprising a cold plate, a heat plate and a thermoelectric material between the cold plate and the heat plate for cooling the cold plate and heating the heat plate when voltage is applied across the thermoelectric material;

a cooling coil adjacent the cold plate;

a fan disposed adjacent the heat plate for cooling said heat plate, wherein the refrigerant is sent through the cooling coil to be cooled by the cold plate; and a collector tank connected to the thermoelectric cooler, wherein the collector tank is configured to collect the refrigerant sent through cooling coil without recycling the refrigerant back to the refrigeration device.

2. The apparatus of claim 1 wherein the cooling coil has an inlet and an outlet, wherein the inlet accepts the refrigerant and the outlet expels cooled refrigerant.

3. The apparatus of claim 2 wherein the refrigerant is gaseous.

4. The apparatus of claim 2 wherein refrigerant enters the inlet of the cooling coil and liquid exits the outlet of the cooling coil.

5. The apparatus of claim 1 further comprising a power source electrically to the thermoelectric cooler.

6. The apparatus of claim 1 further comprising a power source electrically connected to the fan.

7. The apparatus of claim 1 wherein the fan is disposed within a vented housing, and further wherein an airflow is pulled in the vented housing by the fan, propelled towards the heat plate, and subsequently pushed out of the vented housing.

8. The apparatus of claim 1 wherein the cooling coil is a six-pass coil.

9. The apparatus of claim 1 wherein the heat plate has one or more heat sinks disposed thereon for dissipating heat.

10. The apparatus of claim 1 further comprising a housing encapsulating the thermoelectric cooler, the cooling coil, and the fan.

11. The apparatus of claim 10 further comprising a handle disposed on a top of the housing.

12. The apparatus of claim 10 further comprising a plurality of vent holes disposed in the housing.

13. A system for cooling refrigerant, the system comprising:

a refrigeration device utilizing refrigerant for cooling an enclosed space;

a cooling apparatus comprising a thermoelectric cooler comprising a cold plate, a heat plate and a thermoelectric material between the cold plate and the heat plate for cooling the cold plate and heating the heat plate when voltage is applied across the thermoelectric material;

a cooling coil adjacent the cold plate;

a fan disposed adjacent the heat plate for cooling said heat, wherein said cooling coil has an inlet and an outlet, the inlet accepts refrigerant from the refrigeration device and the outlet expels cooled refrigerant; and a collector tank connected to the thermoelectric cooler, wherein the collector tank is configured to collect the refrigerant expelled from the cooling apparatus without recycling the refrigerant back to the refrigeration device.

14. The system of claim 13 further comprising:

a refrigerant reclaimer that moves refrigerant from the refrigeration device to the cooling apparatus;

wherein the refrigerant reclaimer is connected to the refrigeration device on one end and connected to the inlet of the cooling apparatus on another end, and further wherein the container is connected to the outlet of the cooling apparatus.

15. The system of claim 13 wherein the cooling coil is a six-pass coil.

16. The system of claim 13 wherein the heat plate has one or more heat sinks disposed thereon for dissipating heat.

17. A method for cooling refrigerant from a refrigeration device, the method comprising the steps of:

providing a refrigeration device for cooling an enclosed space;

providing a cooling apparatus comprising a thermoelectric cooler comprising a cold plate, a heat plate and a thermoelectric material between the cold plate and the heat plate for cooling the cold plate and heating the heat plate when voltage is applied across the thermoelectric material, a cooling coil adjacent the cold plate; and a fan disposed adjacent the heat plate for cooling said heat plate, wherein said cooling coil comprises an inlet and an outlet, the inlet accepting the refrigerant and the outlet expelling cooled refrigerant;

sending refrigerant into the inlet of the cold plate;

applying voltage across the thermoelectric cooler thereby cooling the cold plate;

cooling the refrigerant in the cooling coil;

cooling the heat plate with the fan;

providing a collection tank connected to the cooling apparatus collecting the cooled refrigerant from the cooling apparatus in a collection tank without recycling the refrigerant back to the refrigeration device.

18. The method of claim 17 further comprising the step of collecting the cooled refrigerant from the outlet of the cooling coil in the collection tank.

19. The method of claim 17 further comprising the steps of:

providing a refrigerant reclaimer for drawing refrigerant from the refrigeration device; and moving the refrigerant from the refrigeration device to inlet of the cooling coil with the refrigerant reclaimer.

* * * * *